United States Patent [19]

Watkins

[11] Patent Number: 4,772,029

[45] Date of Patent: Sep. 20, 1988

[54] COLLAPSIBLE ARROW APPARATUS

[76] Inventor: Mark W. Watkins, 6343 W. Encanto Blvd., Phoenix, Ariz. 85035

[21] Appl. No.: 79,448

[22] Filed: Jul. 30, 1987

[51] Int. Cl.[4] ..... F41B 5/02

[52] U.S. Cl. ..... 273/416

[58] Field of Search ..... 273/416, 419–422

[56] References Cited

U.S. PATENT DOCUMENTS

| | | | |
|---|---|---|---|
| 1,455,075 | 5/1923 | Chapman | 273/416 X |
| 3,945,642 | 3/1976 | Henthorn, Jr. | 273/420 |
| 4,537,176 | 8/1985 | Stravitz et al. | 273/416 X |
| 4,675,683 | 6/1987 | Robinson et al. | 273/416 X |

*Primary Examiner*—Paul E. Shapiro

*Attorney, Agent, or Firm*—H. Gordon Shields

[57] ABSTRACT

An arrow includes a relatively long shaft, with a front shaft portion adjacent to an arrowhead, and the front portion is designed to collapse upon impact so that the rear part of the shaft, the relatively long portion, is reusable after the collapsed, front portion, is removed from the rear portion of the arrow. The two arrow portions are appropriately secured together, but the securing together is not "permanent". Rather, the securing is of such a nature that the two portions may be separated, with the collapsed portion discarded. The rear portion, the relatively long portion, may be reused by remating it to another front, collapsible portion.

21 Claims, 1 Drawing Sheet

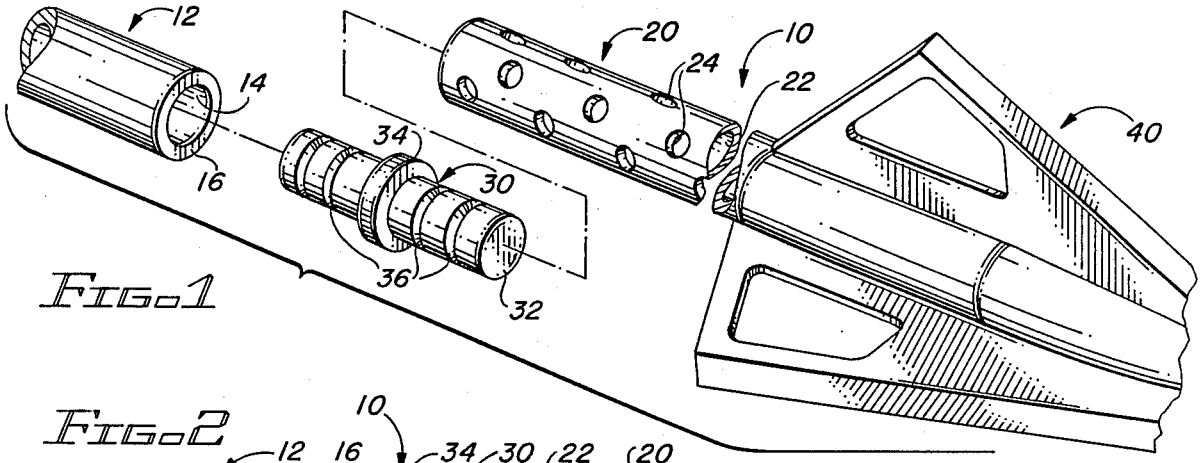
FIG. 1
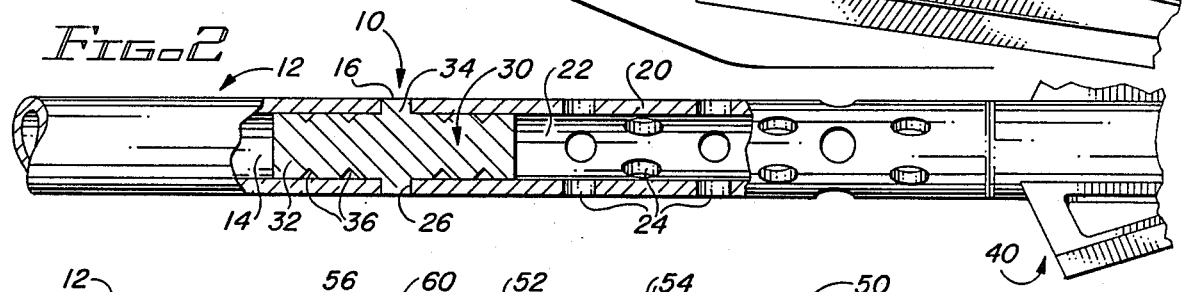
FIG. 2
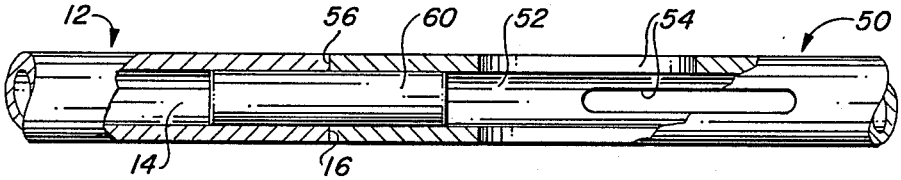
FIG. 3
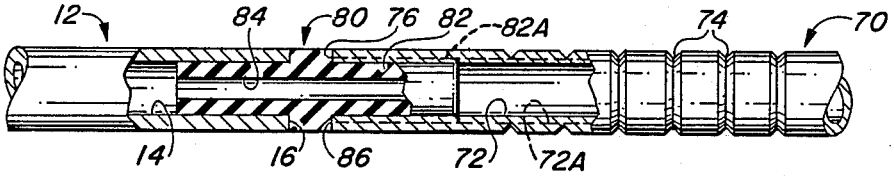
FIG. 4
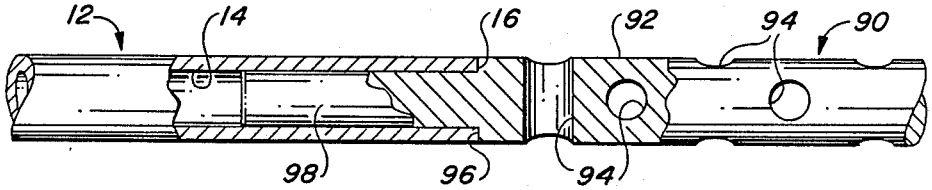
FIG. 5
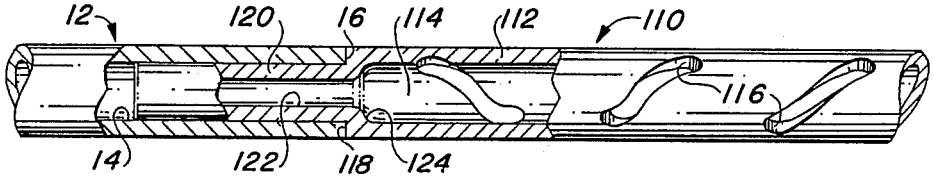
FIG. 6
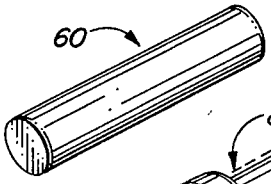
FIG. 3A
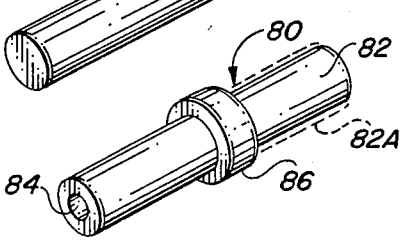
FIG. 4A
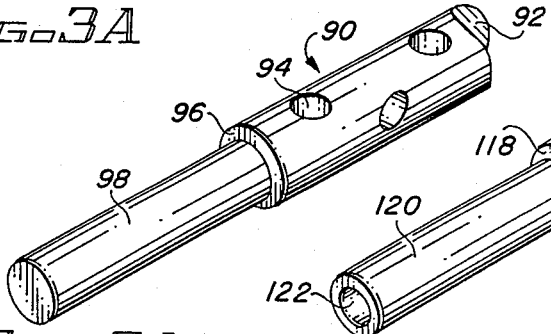
FIG. 5A
FIG. 6A

COLLAPSIBLE ARROW APPARATUS

BACKGROUND OF THE INVENTION

1. Field of the Invention:

This invention relates to arrows, and, more particularly, to arrows having a front, collapsible portion and a rear portion separable from the front, collapsible portion.

2. Description of the Prior Art:

Arrows of the prior art are generally made of a one-piece construction. They may be wood, metal, fiberglass, and the like. An arrowhead is secured to the front part of the arrow.

When hunting in the field, or even target practicing in the field, an archer may occasionally miss his target. Under such circumstances, the arrow is occasionally destroyed due to an adverse impact of the arrow. The destruction may occur in one of several ways. The arrow may be bent, or shattered, by the impact, the arrow may be broken, or damaged, particularly adjacent to the arrowhead. In any case, where there is damage to the arrow shaft itself, the arrow is not reusable and is discarded completely.

The apparatus of the present invention overcomes the deficiencies of the prior art by providing a two-part arrow in which the front portion of the arrow shaft is designed to collapse upon impact with a surface that is hard enough to cause damage to the arrow. The collapsing arrow absorbs the energy which otherwise would be felt along the entire arrow shaft. The front, the collapsible portion, is then removed from the rear portion of the shaft, and the shaft is then reusable.

There have been some arrows of the prior art that have removable portions, and thus the rear portion of the shaft may be reused under certain circumstances.

One example of the prior art arrow with a removable head is shown in U.S. Pat. No. 1,502,499 (Deck). The Deck arrow is a toy arrow with a removable arrowhead. The toy arrow uses a cap at the head of the arrow which remains in a target, allowing the arrow to pull free from the target and from the cap.

U.S. Pat. No. 2,940,759 (West) discloses an arrow that includes an explosive charge in the head. The explosive charge causes the shaft to come free from the arrowhead. When the arrow impacts on a target, the force of the impact sets off the explosive cap or caps at the base of the arrowhead so that the arrow shaft is blown away from the head by the force of the explosion.

U.S. Pat. No. 4,212,463 (Repinski and Pratt) discloses a bleeder arrow which utilizes a hollow shaft. Spaced rearwardly from the head are circumferentially extending grooves on the arrow shaft. The circumferentially extending grooves allow the arrow to be broken at any one of the locations as a wounded animal moves through brush, trees, etc. The arrow shaft itself is hollow to facilitate bleeding. The arrow is designed to be used with a broad head, hunting arrow and to enhance the bleeding of the animal after a hit. The circumferentially extending grooves extend substantially the full length of the arrow shaft. The first groove is spaced apart a substantial distance from the arrowhead so that the entire arrow may be removed from the animal if the hit is not a solid hit. The shaft is, of course, not reusable.

SUMMARY OF THE INVENTION

The invention described and claimed herein comprises an arrow having a two-piece shaft, with the front piece or portion adjacent to the head of the arrow extending for a relatively short distance and designed to collapse upon the hitting of a hard surface. The rear portion of the shaft, which is substantially greater in overall length than the front portion, is removable from the front portion. The front portion is collapsible to absorb the energy from the impact, and it enables the rear portion of the shaft to be removed from the front portion and to be reused. The two portions are secured together and are relatively easily separated for reuse of the rear portion of the arrow. Several different designs to facilitate the collapsing of the front portion are illustrated.

Among the objects of the present invention are the following:

- To provide new and useful arrow apparatus;
- To provide a new and useful collapsible arrow apparatus;
- To provide a new and useful arrow having a shaft made of two pieces secured together;
- To provide a new and useful arrow having a rear portion and a collapsible front portion;
- To provide new and useful reusable arrow apparatus; and
- To provide new and useful arrow having a front collapsible portion and a rear, removable and reusable, portion.

BRIEF DESCRIPTION OF THE DRAWING

FIG. 1 is a perspective view of a portion of an arrow embodying the present invention.

FIG. 2 is a view in partial section of a portion of the apparatus of FIG. 1.

FIG. 3 is a view in partial section illustrating an alternate embodiment of the apparatus shown in FIG. 2.

FIG. 3A is a perspective view of a portion of the apparatus of FIG. 3.

FIG. 4 is a view in partial section illustrating another embodiment of the apparatus of the present invention.

FIG. 4A is a perspective view of a portion of the apparatus of FIG. 4.

FIG. 5 is a view in partial section illustrating another alternate embodiment of the apparatus of the present invention.

FIG. 5A is a perspective view of a portion of the apparatus of FIG. 5.

FIG. 6 is a view in partial section illustrating another embodiment of the apparatus of the present invention.

FIG. 6A is a perspective view of a portion of the apparatus of FIG. 6.

DESCRIPTION OF THE PREFERRED EMBODIMENT

FIG. 1 is a perspective view of a portion of an arrow 10 which includes the apparatus of the present invention. The arrow 10 is, of course, designed to be shot from a bow (not shown) at a target (not shown) of some type. The arrow 10 includes an arrow shaft 12, a collapsible portion 20 secured to the shaft 12 by a connecting link 30, and an arrowhead 40, also secured to the collapsible portion 20. For convenience, FIG. 1 illustrates the various portions of the arrow 10 separated or exploded. FIG. 2 is a view in partial section through a portion of the arrow 10, illustrating the shaft 12 and the collapsible portion 20 secured together by the connecting portion 30, and the arrowhead 40 secured to the collapsible portion 20. For the following discussion, reference will be directed to FIGS. 1 and 2.

The shaft 12 is of a generally tubular, or cylindrical, configuration with a central bore 14 extending axially through the shaft 12. The shaft 12 also includes a front face 16 on the front end of the shaft. The face 16 is substantially perpendicular to the longitudinal axis of the shaft 12.

The collapsible portion 20 is also of a tubular or cylindrical configuration, the outer diameter of which is substantially the same as that of the shaft 12. The collapsible portion 20 includes a bore 22. The diameter of the bore 22 is substantially the same as the diameter of the bore 14 of the shaft 12.

Extending through the collapsible portion 20 are a plurality of holes or apertures 24. The purpose of the apertures 24 is to weaken the collapsible portion 20 so that it will collapse upon the adverse impact with an object, such as a rock, etc. By collapsing under such circumstances, the collapsible portion 20 absorbs the energy which might otherwise be directed to the shaft 12. In this manner, the shaft 12 remains generally unharmed, and thus may be used again.

The collapsible portion 20 also includes a rear end face 26. The rear end face 26 is substantially perpendicular to the longitudinal axis of the collapsible portion 20.

The connecting portion or link 30 includes a generally cylindrical portion 32 with a central outwardly extending radial flange 34. The flange 34 extends radially outwardly from the cylindrical portion 32 from about the midpoint of the cylindrical portion 32. The diameter of the outwardly radially extending flange 34 is substantially the same as the diameter of the shaft 12 and the collapsible portion 20 so that, when the three portions are secured together, as shown in FIG. 2, a substantially continuous outer surface is defined by the three portions.

There is a plurality of circumferentially extending grooves 36 on the outer periphery of the cylindrical portion 32. The purpose of the grooves 36 is to enhance the assembling of the three portions.

When assembled together, as shown in FIG. 2, the end faces 16 and 26 of the shaft 12 and the collapsible portion 20, respectively, are disposed against the outer, opposite, surfaces of the radially extending flange 34 of the connecting portion 30. This assures that an equal amount of the connecting portion 30 is disposed within the bores 14 and 22, respectively, of the shaft 12 and the collapsible portion 20.

FIG. 3 is a view in partial section of an alternate embodiment of collapsible portion 50 secured to the shaft 12. FIG. 3A is a perspective view of the connecting link 60. For the following discussion, reference will primarily be made to FIGS. 3 and 3A.

The alternate embodiment collapsible portion 50 is also generally cylindrical in configuration, with an interior bore 52 which is substantially the same diameter as the bore 14 of the shaft 12. The alternate embodiment includes a plurality of axially extending slots 54 which communicate with the bore 52. The collapsible portion 50 includes an end face 56. The end faces 56 and 16 of the collapsible portion 50 and the shaft 12 are shown in FIG. 3 as abutting each other.

A cylindrical connecting link 60 is used to connect the shaft 12 to the collapsible portion 50. The connecting link 60 is a solid cylindrical portion, or it may be tubular cylindrical portion, with a longitudinally axially extending slot 60 extending therethrough, if desired. It will be noted that there is no radially outwardly extending flange from the connecting portion 60. Accordingly, the end faces 16 and 56 are disposed against each other in an abutting relationship. If desired, and to insure that about half of the connecting link 60 is disposed within each bore 14 and 52, the exterior of the connecting portion 60 may be painted or striped, to allow a user to determine about how much of the connecting portion should extend into the shaft and the collapsible portion, respectively.

FIG. 4 is an alternate embodiment of the arrow apparatus 10, using an alternate embodiment collapsible portion 70, and with an alternate embodiment connecting link 80 securing the shaft 12 to the collapsible portion 70. FIG. 4A is a perspective view of the connecting portion 80. For the following discussion, reference will be made to FIGS. 4 and 4A.

The collapsible portion 70 includes a longitudinally axially extending bore 72. The connecting link 80 is disposed within the bore 72.

On the outside of the collapsible portion 70 is a plurality of circumferentially extending grooves 74. The purpose of the circumferentially extending grooves is, like the axial slots 54 in FIG. 3, and the holes or apertures 24 in FIGS. 1 and 2, to weaken the connecting portion 70 so that it will collapse to absorb the energy which might otherwise be directed to the shaft 12, and thus to protect the shaft 12. The collapsible portion 70 includes an end face 76. The end face 76 is substantially perpendicular to the axis of the collapsible portion 70 and of its bore 72.

The connecting link 80 includes a generally tubular portion 82 with an axially extending bore 84 extending through the tubular portion 82. The tubular portion 82 includes a radially outwardly extending flange 86. The flange 86 is disposed about the center portion of the connecting link 80. When the connecting link 80 is used to secure the shaft 12 to the collapsible portion 70, the end faces 16 and 76 of the shaft 12 and the collapsible portion 70, respectively, abut opposite or outer end faces of the radially outwardly extending flange 86, The outer diameter of the flange 86 is substantially the same as the outer diameter of the shaft 12 and the collapsible portion 80 so as to provide, when secured together as shown in FIG. 4, a substantially continuous outer surface.

FIG. 5 is a view in partial section through the shaft 12 and with an alternate embodiment collapsible portion 90 secured thereto. FIG. 5A is a perspective view of a portion of the collapsible portion 90. For the following, reference will primarily be made to FIGS. 5 and 5A.

The collapsible portion 90 includes a front portion 92 and a rear portion 98. The rear portion 98 is of a lesser diameter than the front portion 92. A shoulder 96 extends at the juncture of the front portion 92 and the rear portion 98. The rear portion 98 comprises a connecting portion for connecting the collapsible element 90 with the shaft 12. The outer diameter of the rear portion 98 is substantially the same as the inner diameter of the bore 14 of the shaft 12. The outer diameter of the front portion 92 is substantially the same as the outer diameter of the shaft 12. The face 16 of the shaft 12 is shown in an abutting relationship with the shoulder 96.

The collapsible portion 90 is a solid, cylindrical portion, as contrasted with the tubular cylindrical portions of the other embodiments discussed above. The solid portion is made of substantially lesser density material than the material out of which the tubular shaft portion is made.

A plurality of holes or bores 94 extend diametrically through the front portion 92 for the purpose of weakening the collapsible portion 90 so that it will absorb the energy of an adverse impact, such as with a rock, etc., and thus will deform upon such impact and will prevent the shaft 12 from sustaining damage so that the shaft 12 may be reused.

As shown in FIGS. 5 and 5A, the diametrically extending holes 94 are offset one from another. This is the preferable configuration. However, if desired, the holes may also be intersecting. The holes 94 are shown substantially perpendicular to each other. The holes may, if desired, be in a random orientation or may be in a staggered orientation axially along the collapsible portion 90.

Under some circumstances, depending on the density and/or other physical properties of the material out of which the collapsible portion 90 is made, holes may not be required for weakening purposes to insure collapsing. Thus, an expanded type resin may be used for the collapsible portion 90 that will have sufficient strength and rigidity to remain in proper alignment with the shaft 12 under normal usage and normal target impact. However, collapsing or bending, etc., in absorbing energy, will occur when the arrow is subject to an adverse impact.

FIG. 6 is a view in partial section of another alternate embodiment of collapsible portion 110 secured to the shaft 12. FIG. 6A is a perspective view of the alternate embodiment collapsible portion 110. For the following discussion, reference will primarily be made to FIGS. 6 and 6A.

The alternate embodiment collapsible portion 110 includes a front cylindrical portion 112 and a rear cylindrical portion 120. A shoulder 118 extends between the front cylindrical portion 112 and the rear cylindrical portion 120. The outer diameter of the front cylindrical portion 112 is substantially the same as the outer diameter of the shaft 12. The outer diameter of the rear cylindrical portion 120 is substantially the same as the diameter of the bore 14 of the shaft 12.

The front cylindrical portion 112 includes an axially extending bore 114. The rear cylindrical portion 120 includes an axially extending bore 122. The diameters of the bores 114 and 122 is different, and a shoulder 124 extends radially between the two bores at their juncture.

The front cylindrical portion 112 includes a plurality of diagonally extending slots 116. The slots 116 may be in a relatively regular orientation with respect to the cylindrical portion 112, or they may be random, as desired. The purpose of the slots 116 is, of course, to weaken the front cylindrical portion 112 to absorb energy when the arrow impacts a rock, etc., so that the front cylindrical portion 112 will deform in absorbing the energy of the impact, leaving the shaft 12 substantially undamaged.

As shown in FIG. 6, the shoulder 118 of the collapsible portion 110 is disposed against, and thus abuts, the end face 16 of the shaft 12, when the two arrow portions are secured together. The tubular portion 120 extends into the bore 14 to secure the shaft 12 to the tubular portion 110.

In FIGS. 1–6, a number of different configurations of collapsible arrow portions are illustrated. The collapsible portions are all designed to absorb energy by deforming when the arrow 10 adversely impacts an undesirable, and inadvertent, target. The collapsing of the front portion in absorbing the energy of the impact allows the shaft 12 to be removed from the collapsible portions and accordingly to be reused. However, the shaft 12 sustains substantially no damage and accordingly is reusable.

As shown in FIGS. 2, 3, 3A, 4, and 4A, there may be separate connecting links between the arrow shaft 12 and a collapsible portion. On the other hand, as shown in FIGS. 5, 5A, and 6, 6A, the collapsible portion may include an integral connecting element, thus eliminating a separate connecting element.

It will be noted that the arrow shaft 12 has been referred to as a tubular shaft having a bore 14. The shaft 12 may, also, be solid, etc. The bore 14 may be a relatively short bore of only sufficient length to receive the appropriate portion of the connecting link.

Referring again to FIGS. 4 and 4A, it will be noted that there are shown dotted line modifications to the embodiment. A larger diameter bore 72A is shown, requiring a larger diameter cylindrical connecting portion 82A. The wall thickness of the collapsible front portion 70 is reduced to weaken the wall to allow the weakened wall to collapse upon an adverse impact. The reduced wall thickness may not require the grooves 74 or any of the other wall weakening measures illustrated and discussed. The reduced wall thickness may alone be sufficient to allow the energy absorbing collapsing of the front portion. The wall thickness of the shaft 12 remains as shown, and is thus relatively thick, as compared with the relatively thin wall thickness of the collapsible front portion 70.

It will also be noted that no specific materials have been mentioned or discussed. Arrows may be made of many different materials, and more materials are being developed, and will be developed, in the future, that may be usable for arrows. Typically, arrows may be made of wood, aluminum, fiberglass, graphite, boron, and other materials. As indicated above, the arrows may be solid or tubular.

With respect to the term "tubular", as used in the specification and claims, it will be further noted that the term need not be limited to a cylindrical tubular element. The term may be applicable to the other tubular forms, also.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Collapsible arrow apparatus comprising, in combination:

arrow shaft means adapted to be shot from a bow at a target, including a shaft, and a first bore in the shaft;

an arrowhead;

collapsible means secured to the arrowhead for absorbing energy upon an adverse impact, including a collapsible portion; and connecting means for connecting the arrow shaft means to the collapsible means, including a first portion extending into the first bore of the shaft.

2. The apparatus of claim 1 in which the collapsible portion of the collapsible means is a tubular portion.

3. The apparatus of claim 2 in which the collapsible means includes means for weakening the tubular portion.

4. The apparatus of claim 3 in which the means for weakening the tubular portion includes a plurality of apertures extending through the tubular portion.

5. The apparatus of claim 3 in which the means for weakening the tubular portion includes a plurality of circumferentially extending grooves.

6. The apparatus of claim 3 in which the collapsible means includes a second bore in the tubular portion.

7. The apparatus of claim 6 in which the connecting means further includes a second portion extending into the second bore in the tubular portion.

8. The apparatus of claim 7 in which the connecting means further includes a radially extending flange between the first portion and the second portion, and the shaft and the tubular portion abut the radially extending flange.

9. The apparatus of claim 3 in which the means for weakening the tubular portion includes a plurality of slots extending through the tubular portion.

10. The apparatus of claim 9 in which the plurality of slots extend axially along the tubular portion.

11. The apparatus of claim 9 in which the plurality of slots extend diagonally along the tubular portion.

12. The apparatus of claim 9 in which the means for weakening the tubular portion includes a plurality of apertures extending through the tubular portion.

13. The apparatus of claim 2 in which the first portion of the connecting means is secured to the tubular portion of the collapsible means and extends outwardly therefrom.

14. The apparatus of claim 13 in which the connecting means further includes a third bore.

15. The apparatus of claim 14 in which the collapsible means includes a fourth bore, and the third bore of the connecting means communicates with the fourth bore.

16. The apparatus of claim 1 in which the connecting means includes a plurality of circumferentially extending grooves.

17. Collapsible arrow apparatus comprising, in combination:

an arrow shaft;

an arrowhead; and collapsible means secured to the arrow shaft and to the arrowhead and deformable upon absorbing energy from an adverse impact to prevent damage to the arrow shaft.

18. The apparatus of claim 17 in which the collapsible means includes a deformable portion, and a connecting portion for connecting the deformable portion to the arrow shaft.

19. The apparatus of claim 18 in which the collapsible means further includes means for weakening the deformable portion for absorbing energy by deforming upon an adverse impact.

20. The apparatus of claim 18 in which the deformable portion includes a bore, and the means for weakening the deformable portion communicates with the bore.

21. The apparatus of claim 17 in which the collapsible means includes a first tubular portion having a relatively thick wall and a second tubular portion having a relatively thin wall.

* * * * *